US008231030B2

(12) United States Patent
Lassota

(10) Patent No.: US 8,231,030 B2
(45) Date of Patent: Jul. 31, 2012

(54) BEVERAGE DISPENSER WITH ELEVATED DISPENSE CONTROL, METHOD OF ASSEMBLY AND METHOD OF USE

(75) Inventor: Zbigniew G. Lassota, Long Grove, IL (US)

(73) Assignee: Food Equipment Technologies Company, Inc., Lake Zurich, IL (US)

( * ) Notice: Subject to any disclaimer, the term of this patent is extended or adjusted under 35 U.S.C. 154(b) by 306 days.

(21) Appl. No.: 12/251,605

(22) Filed: Oct. 15, 2008

(65) Prior Publication Data

US 2009/0255956 A1 Oct. 15, 2009

Related U.S. Application Data

(60) Provisional application No. 61/000,090, filed on Oct. 23, 2007.

(51) Int. Cl.
*B67D 7/06* (2010.01)

(52) U.S. Cl. ..... 222/185.1; 222/1; 222/509; 222/510; 222/518; 222/559; 251/87; 251/299; 251/357

(58) Field of Classification Search ..... 222/180, 222/181.1–181.3, 182, 185.1, 186, 517–518, 222/469–470, 472, 509–510, 559, 602; 251/298–299, 57–58, 84, 87, 357; 426/594–597; 99/355, 410, 415, 418, 444; 4/323, 392–393, 4/413–414

See application file for complete search history.

(56) References Cited

U.S. PATENT DOCUMENTS

| | | | | | |
|---|---|---|---|---|---|
| 435,188 | A * | 8/1890 | Puffer | 222/185.1 |
| 583,615 | A * | 6/1897 | Borcher | 141/344 |
| 670,792 | A * | 3/1901 | Lippincott | 222/160 |
| 824,468 | A * | 6/1906 | Calley | 222/442 |
| 1,047,873 | A * | 12/1912 | Allen | 222/559 |
| 1,146,505 | A * | 7/1915 | Lawrence | 4/414 |
| 1,620,689 | A * | 3/1927 | Reiling | 141/345 |
| 1,883,169 | A * | 10/1932 | Vogel | 221/281 |
| 1,950,160 | A * | 3/1934 | Blank | 222/160 |
| 3,840,159 | A * | 10/1974 | Downey | 222/509 |
| 6,422,432 | B1 * | 7/2002 | Alldredge | 222/510 |

* cited by examiner

*Primary Examiner* — Kevin P Shaver
*Assistant Examiner* — Andrew Bainbridge
(74) *Attorney, Agent, or Firm* — James W. Potthast; Potthast & Associates

(57) ABSTRACT

A beverage dispenser has a container for beverage fluid that has a flat bottom that is above a space large enough to place a glass or cup. The container has a sidewall and a top edge of an open container that has a removable lid. A pair of actuator guards are on either side of a space near but below the top edge of the container where an actuator is located that projects through a notch in the top edge, plunging downwardly inside the inner wall of the container sidewall and jutting straight out to form a fork. This fork selectively holds a plunger that has a long shaft and plug that fits into a hole in the bottom wall of the container. This hole and plug form a valve. The valve can be opened when the actuator is depressed between the actuator guards towards the container's sidewall, which pivots the fork upwardly which in turn lifts the plunger and plug to open the valve for dispensation.

19 Claims, 4 Drawing Sheets

BEVERAGE DISPENSER WITH ELEVATED DISPENSE CONTROL, METHOD OF ASSEMBLY AND METHOD OF USE

CROSS-REFERENCE TO RELATED APPLICATION

This application claims the benefit under 35 U.S.C 119(e) of U.S. Provisional Patent Application No. 61/000,090 of the present inventor filed Oct. 23, 2007 and entitled "Beverage Dispenser with Elevated dispense Control".

SUMMARY OF THE INVENTION

1. Field of the Invention

This invention generally relates to beverage dispensers and more particularly to beverage dispensers with a manually controlled beverage dispensing faucet.

2. Discussion of the Prior Art

Commercial beverage dispensers of the type that have a hollow, body with an open top for receipt of beverage and a bottom supported by a base over a counter top or other underlying support surface are well known. Such beverage dispensers also have a manually operated, downwardly extending dispense nozzle, or dispense valve, that is forwardly extended over and spaced directly above a location on the counter for support of an individual serving sized container, such as a coffee cup, glass, etc. The manual control actuator for the dispense valve in such known dispensers is located directly above and adjacent the dispense valve and the bottom of the container.

This location disadvantageously requires the user to place one hand directly above the dispenser valve and in potential harms way. In the case of the dispenser containing a scolding hot beverage, such as scolding hot tea or coffee, the user may be burned by hot steam issuing from hot beverage as it leaves the dispenser and falls through the air into the serving sized container. Also, the user may be burned by upward splashing of the beverage when it strikes other hot beverage in the serving sized container into which the beverage is being served. Even in the absence of hot beverages splashing of the beverage onto the hand of the user should be avoided due to considerations of hygiene and cleanliness, particularly in the case of a commercial food service and handling environment.

It has been known to provide various shaped shields to protect a users hand during a dispenser operation but such shields are not complete solutions to the problem plus they present an unclean or unsightly appearance.

Accordingly, the inventor has determined that there is a need to overcome this problem.

SUMMARY OF THE INVENTION

It is therefore an object of the present invention is to provide a dispenser with a dispenser valve controller that overcomes the problems of known dispensers noted above and which enables a different, if not improved, aesthetic appearance from conventional dispensers.

This objective is achieved in part by provision of a beverage dispenser with, a dispenser body with top, a bottom, surrounding walls including a front wall extending between the top and the bottom and a base supporting the bottom above a support surface a drain hole in the bottom, and a manually operable, drain valve actuator assembly including a drain actuator pivotally mounted to the body, a movable valve member linked to the drain actuator and having a plug receivable in blocking engagement within the drain hole to close the drain hole, manual engagement of the actuator causing the plug to rise out of blocking engagement with the drain hole to allow beverage within the dispenser body to drain out of the drain hole.

Preferably, the actuator is pivotally mounted to the dispenser body, and a pair of actuator guards located on either side of the actuator to protect the actuator against inadvertent actuation and to provide lateral guidance for relative pivotal movement of the actuator. The actuator is pivoted inwardly when in an actuated open position with the actuator being more deeply recessed relative to the actuator guards then when the actuator is in a normally closed, non-actuated position, when the actuator is only relatively slightly recessed.

In the preferred embodiment, the front wall has a mounting slot at the top of the dispenser body, the actuator has an member with a manual engagement surface that is located on the outside of the front wall and extends upwardly to a downturned hook section, said hook section being hooked over and supported by the mounting slot. The mounting slot is in the top edge of the front wall and a portion of the front wall immediately beneath the slot is sandwiched between a downturned part of the hook section and an inner surface of a top part of the engagement member, and the downturned part terminates in a generally horizontal valve engagement section.

The objective of the invention is also achieved in part by providing a method of assembling a valve assembly with a beverage dispenser having a hollow dispenser body, a top and a bottom with a drain hole, by performing the steps of hooking an actuator with an external actuator surface at one end and an internal valve member engagement surface over a slot in the top of the dispenser body, placing an elongate movable valve handle with a collar into the dispenser body, pushing a narrow frontal slot between a pair of fingers carried by the valve engagement surface until being resiliently spread apart sufficiently to allow passage of the handle into snug engagement within the frontal slot and beneath the collar.

Obtaining the objective of the invention is also achieved by providing a method of dispensing beverage from a beverage dispenser, by performance of the steps of pressing on a valve actuator located adjacent to the top of the beverage dispenser to open a valve in the bottom of the dispenser, and dispensing beverage from the valve at the bottom of the dispenser at a location substantially spaced beneath the valve actuator.

Preferably, the valve actuator is pivotally mounted to the top of the dispenser body and the step of pressing includes the step of pivoting the valve actuator to move a valve plug out of closure relationship with a valve opening of the valve and the valve actuator is protected against inadvertent actuation by sandwiching the valve actuator with a pair of valve actuator guards. The valve is closed by releasing pressure on the valve actuator to allow gravity to move the actuator to move to a closed position. Sides of a tapered plug are used to guide the plug into a closed position within a drain hole.

BRIEF DESCRIPTION OF THE DRAWING

Achievement of the foregoing object of the invention will be demonstrated and further objects and advantageous features are described in detail below with reference to a preferred embodiment the dispenser of the invention shown in the drawings, in which.

DETAILED DESCRIPTION

Figure 1:
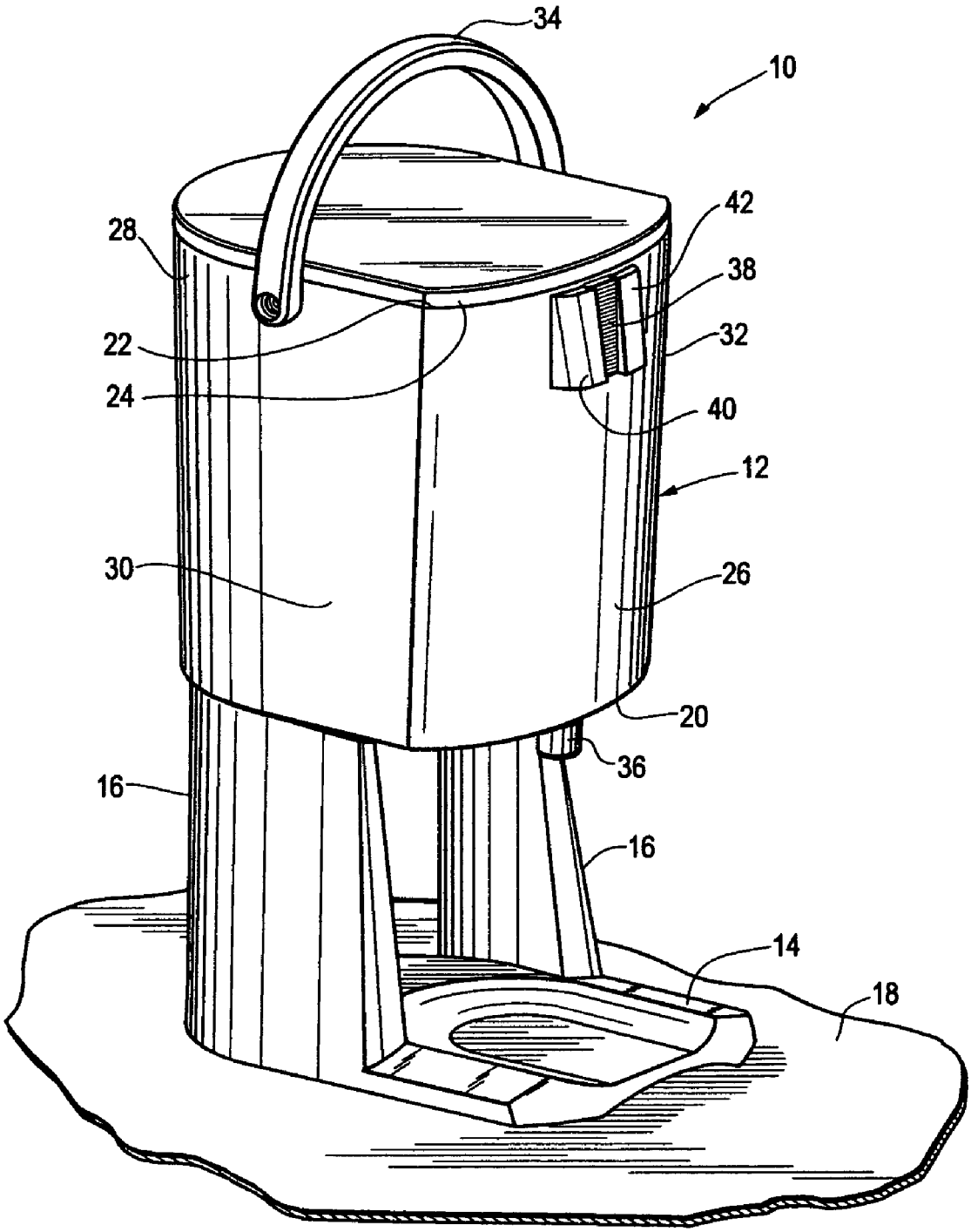
FIG. 1 is a perspective view of the preferred embodiment of the dispenser of the present invention.

Referring now to FIG. 1, the preferred embodiment of the beverage dispenser 10 is seen to have a dispenser body 12 supported above a base 14 by legs 16. The base 14, in turn, is supported by an underlying counter top 18 or other support surface. The dispenser body has a generally horizontal, flat bottom 20, an upwardly facing open top 22 with a mating, generally horizontal, removable, flat, top closure 24 closing the open top 22. Extending vertically between the top 22 and the bottom 20 are a convex front wall 26, and convex back wall 28 and a pair of parallel, planer, side walls 30 and 32 that extend between opposed ends of the front wall 26 and the back wall 28. A carry handle 34 extends over the top closure 24 between opposite ends attached to tie side walls 30 and 32, respectively. The base 14, the top closure 24, the handle 34, the valve actuator 38 and the legs 16 are preferably made from a plastic such as polypropylene, while the dispenser body 12 is preferably made of stainless steel.

Extending vertically downwardly from the bottom 20 and adjacent the front wall 26 is a drain pipe 36. Beverage within the body 12 is dispensed through the drain pipe 36 during actuation of a manually operable, drain valve actuator 38 mounted to the front wall 26. The base 14 has an upper surface directly beneath the drain pipe 36 for support of a single serving sized container (not shown), such as a coffee cup, tea cup, etc. beneath the drain pipe during dispensing of the beverage into the container.

In order to achieve the object of the invention of protecting users from burns and splashes of beverage on their hand during dispensing of the beverage, the manual, drain valve actuator 38 is substantially elevated above the drain pipe 36 and is preferably adjacent the top 22, as shown. A pair of actuator guards 40 and 42, located on either side of the actuator 38, protects the actuator 38 against inadvertent actuation and provides lateral guidance for relative pivotal movement of the actuator 38. When the actuator 38 is pivoted inwardly to an actuated open position, as shown in FIG. 1, the outwardly facing surface of the actuator 38 is deeply recessed relative to the outwardly facing surfaces of the actuator guards 40 and 42, and when the actuator is in the normally closed, non-actuated position, the surfaces of the actuator 38 and the actuator guards 40 and 42 are only slightly recessed.

Figure 2:
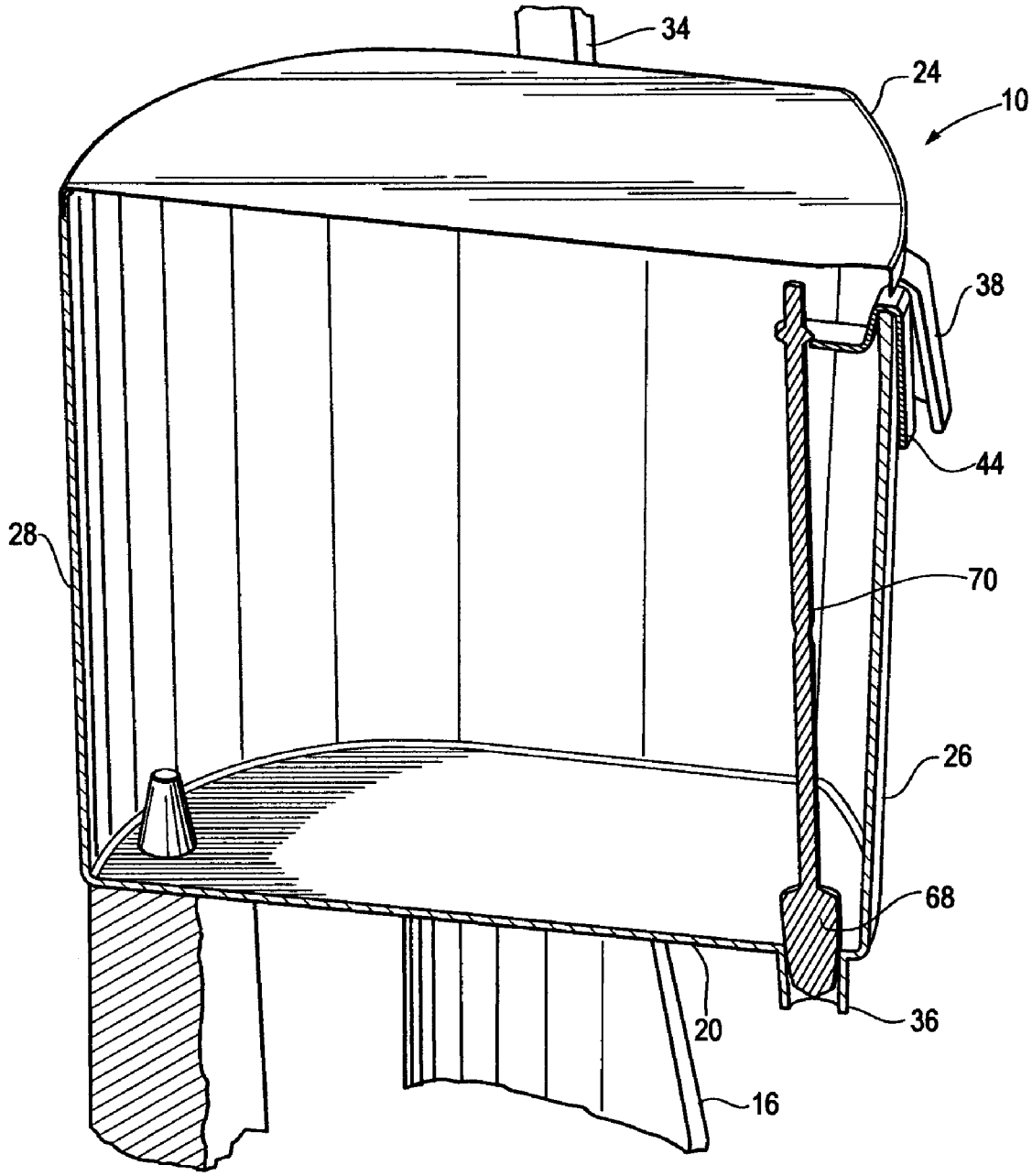
FIG. 2 is another perspective view of the dispenser of FIG. 1 but relatively enlarged and with a portion cut away to reveal the internal workings of the dispense valve in an and the manual dispenser valve actuator in an actuated open condition.
Figure 3:
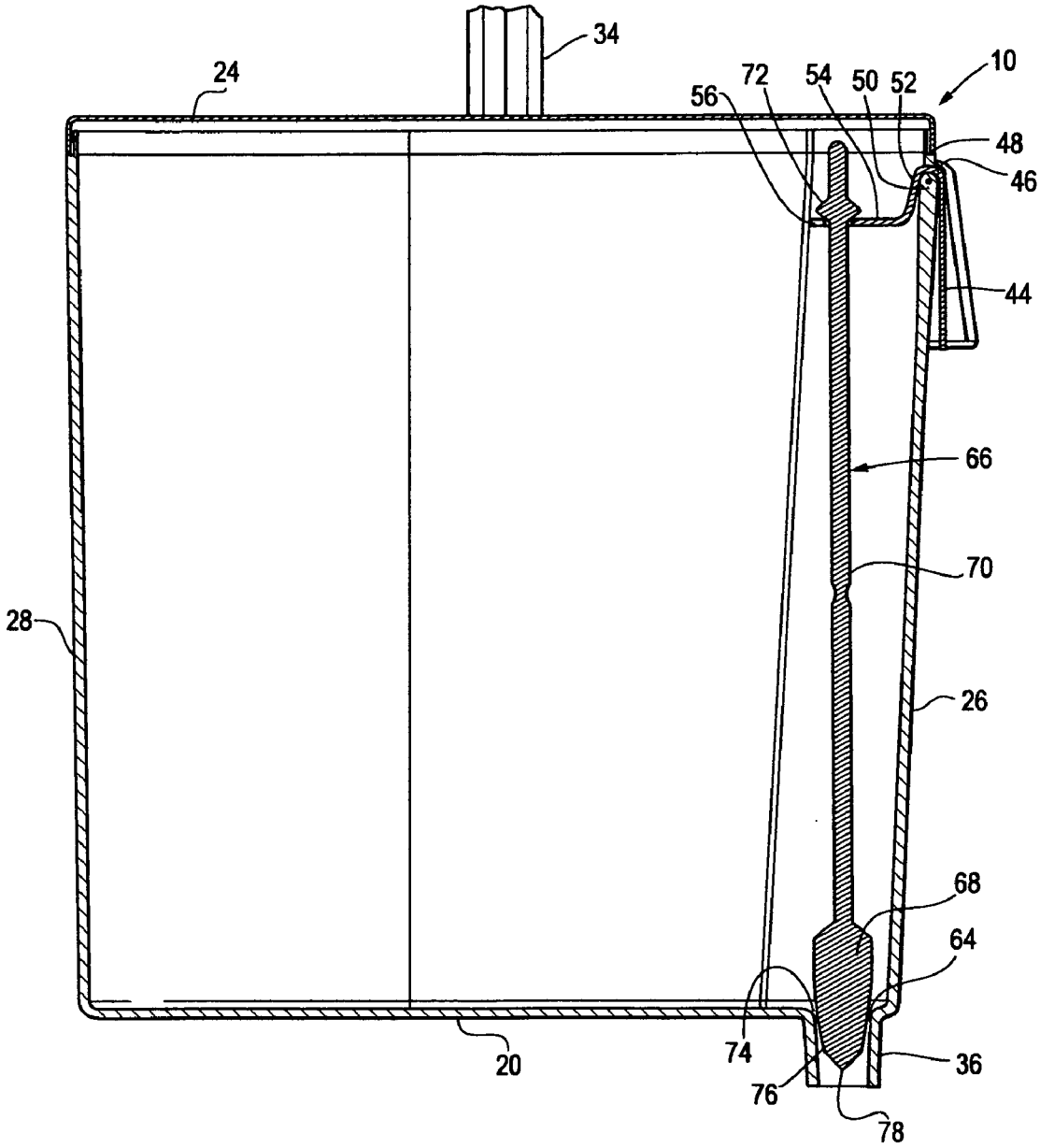
FIG. 3 is a sectional side view of the dispenser of FIGS. 1 and 2 showing the dispense valve in an actuated, open position.
Figure 4:
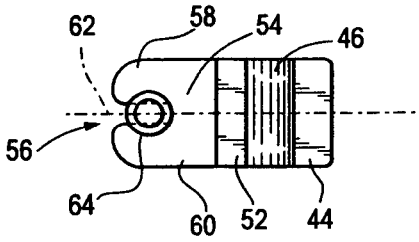
FIG. 4 is a plan view of the dispense valve actuator of FIG. 3.

Referring now to FIGS. 2 and 3, the actuator 38 is seen to have a manual engagement member 44 that is located on the outside of the front wall 26. The engagement surface 44 extends upwardly to a down-turned hook section 46 that is hooked over and supported by the top edge 50 of a mounting slot 48. The mounting slot is in the top edge of the front wall 26, and the portion of the wall 26 immediately beneath the top edge 50 of the slot 48 is sandwiched between a downturned part 52 of the hook section 46 and the inner surface of the top part of the engagement member 44. The downturned part 52 terminates in a generally horizontal valve engagement section 54. Referring also FIG. 4, the valve engagement section carries a valve engagement fork 56 with a pair of opposed, mirror imaged arms 58 and 60 separated by relatively narrow frontal slot and a generally circular aft slot 62.

The valve assembly includes the valve opening 64 which is the inlet opening of the drain pipe 36 and a movable valve member 66. The movable valve member 66 includes a plug 68 attached to one end of a relatively narrow, elongate, cylindrical handle 70. Adjacent the top of the handle is a fork engagement collar 72 that extends radially outwardly from the handle 70 and overlies the top of the fork 56 with the handle snugly seated within the slot 64. Consequently, when the engagement member 44 is pivoted against the front wall 26, as shown, the handle 70 and the plug 68 are held upwardly in a relatively elevated position in which a drainage cap 74 is created between the sides of the plug 68 and the interior surface of the valve opening 64 to allow beverage to pass through the drain pipe 36. The handle 70 and plug are preferably integrally formed together of stainless steel.

During assembly, first the actuator 38 is located in the slot 48 as shown. Then the movable valve member 66 is placed into the hollow body of the dispenser 10 and pushed against the narrow frontal slot 62 until the fingers 58 and 60 are resiliently spread apart sufficiently to allow passage of the handle 70 into snug engagement within the relatively larger circular slot 64 directly beneath the collar 72.

Figure 5:
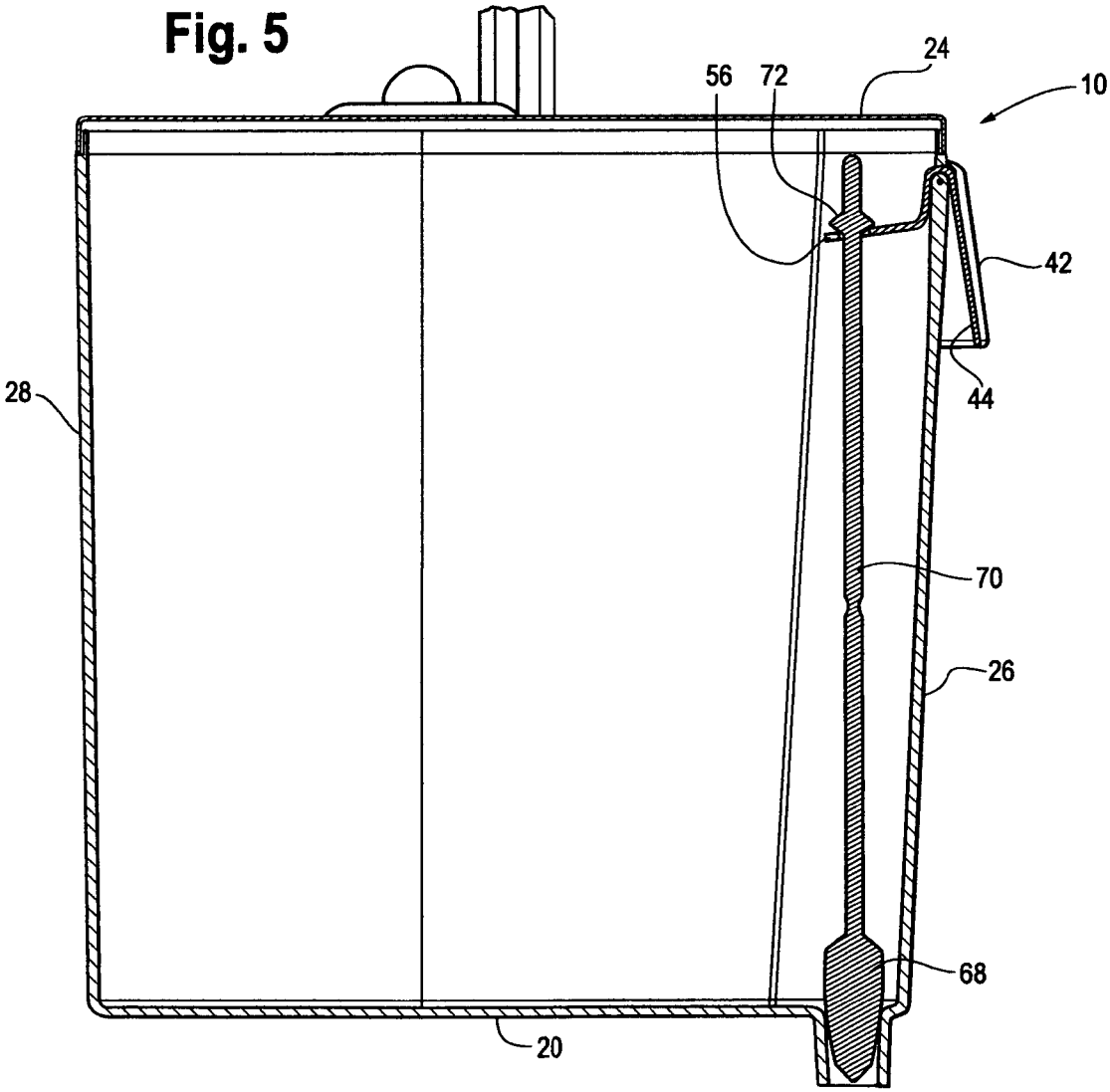
FIG. 5 is a sectional side view of the dispenser similar to that of FIG. 3 but in which the dispenser valve is shown in a non-actuated, normally open, position.

Referring now to FIG. 5, when the engagement member is released, the weight of the movable valve member 66 causes it to move downwardly and thus the engagement member 44 to pivot in a counter-clockwise direction about the top edge 50 of the slot 48. The engagement member 44 is then positioned at an angle extending outwardly and downwardly away from the front wall 26 with the frontal surface only slightly recessed relative to the actuator guards 40 and 42, as shown. In this relatively lowered, closed position, the plug 68 is sufficiently inserted into the drain pipe 36 to close, or eliminate, the gap 74 or any other gaps between the sides of the plug 68 and the drain hole 64. The plug has inwardly, downwardly tapered conical sides 76 and a generally pointed end 78 to facilitate a smooth sliding fit of the plug 68 into the drain pipe 36.

While a specific embodiment has been described above in detail, it should be appreciated that many variations may be made thereto without departing from the scope of the invention.

The invention claimed is:

1. A beverage dispenser, comprising:

a dispenser body with an open top with a top edge and a removable closure for closing the open top, a bottom beneath the top, surrounding walls including a front wall extending between the top and the bottom and having a middle between the top and the bottom, and means supporting the bottom above a support surface;

a drain hole in the bottom; and a manually operable, drain valve actuator assembly including a manually engagable drain actuator releasably, pivotally mounted to the front wall at a location adjacent to the top but spaced beneath the top edge and spaced from the middle of the front wall and from the drain hole;

a movable valve member connected directly to the drain actuator and having a plug receivable in blocking engagement within the drain hole to close the drain hole, manual pivoting the manually engagable actuator toward the front wall relative to the body to raise the plug out of blocking engagement with the drain hole to allow beverage within the dispenser body to drain out of the drain hole.

2. The beverage dispenser of claim 1 in which the actuator is pivotally mounted to the dispenser body and is accessible on an outside of the body, and including a pair of actuator guards located on the outside of the body adjacent the top and on either side of the actuator to protect the actuator against inadvertent manual actuation and to provide lateral guidance for relative pivotal movement of the actuator.

3. The beverage dispenser of claim 2 in which the actuator is pivoted inwardly when in an actuated open position with the actuator being more deeply recessed relative to the actuator guards then when the actuator is in a normally closed, non-actuated position, when the actuator is only relatively slightly recessed.

4. The beverage dispenser of claim 1 in which the supporting means includes a base with an upper surface directly beneath the drain hole for support of a single serving sized container beneath the drain hole during dispensing of the beverage into the container.

5. The beverage dispenser of claim 1 including a drain pipe connected to the drain hole and extending downwardly from the bottom.

6. A beverage dispenser, comprising:

a dispenser body with top, a bottom, surrounding walls including a front wall extending between the top and the bottom and means supporting the bottom above a support surface;

a drain hole in the bottom; and a manually operable, drain valve actuator assembly including a manually engagable drain actuator pivotally mounted to the body, a movable valve member connected directly to the drain actuator and having a plug receivable in blocking engagement within the drain hole to close the drain hole, manual pivoting of the manually engagable actuator relative to the body raising the plug out of blocking engagement with the drain hole to allow beverage within the dispenser body to drain out of the drain hole; and in which the front wall has a mounting slot at the top of the dispenser body, and the actuator has an engagement member with a manual engagement surface that is located on the outside of, and faces outwardly from, the front wall and extends upwardly to a down-turned hook section, said hook section being hooked over and supported by the mounting slot.

7. The beverage dispenser of claim 6 in which the mounting slot is in the top edge of the front wall, and a portion of the front wall immediately beneath the slot is sandwiched between a downturned part of the hook section and an inner surface of a top part of the engagement member.

8. The beverage dispenser of claim 7 in which the downturned part terminates in a generally horizontal valve engagement section.

9. The beverage dispenser of claim 8 in which the valve engagement section carries a valve engagement fork with a pair of opposed, mirror imaged arms separated by relatively narrow frontal slot and a generally circular aft slot.

10. The beverage dispenser of claim 9 in which the plug is attached to an end of an elongate handle with a fork engagement collar that extends radially outwardly from the handle and overlies the fork with the handle being snugly seated within the slot, said handle and plug being held upwardly in a relatively elevated position when the engagement member is pivoted against the front wall to create a drainage gap between the sides of the plug and the drain hole to allow beverage to pass through the drain hole.

11. The beverage dispenser of claim 10 in which the handle and the plug are integrally formed together from a single work piece of stainless steel.

12. A beverage dispenser, comprising:

a dispenser body with top, a bottom, surrounding walls including a front wall extending between the top and the bottom, means supporting the bottom above a support surface and a mounting slot, with a top edge, in the top of the dispenser body;

a drain hole in the bottom; and a manually operable, drain valve actuator assembly including a manually engagable drain actuator pivotally mounted to the body, a movable valve member connected directly to the drain actuator and having a plug receivable in blocking engagement within the drain hole to close the drain hole, manual pivoting of the manually engagable actuator relative to the body raising the plug out of blocking engagement with the drain hole to allow beverage within the dispenser body to drain out of the drain hole, the engagement member having sufficient weight to cause the movable valve member to move downwardly to pivot the engagement member about a top edge of the slot.

13. The beverage dispenser of claim 12 in which the plug has inwardly, downwardly tapered conical sides, and a generally pointed end to facilitate a smooth sliding fit of the plug into the drain hole.

14. A beverage dispenser, comprising:

a dispenser body with top, a bottom, surrounding walls including a front wall extending between the top and the bottom and means supporting the bottom above a support surface;

a drain hole in the bottom; and a manually operable, drain valve actuator assembly including a manually engagable drain actuator pivotally mounted to the body, a movable valve member connected directly to the drain actuator and having a plug receivable in blocking engagement within the drain hole to close the drain hole, manual pivoting of the manually engagable actuator relative to the body raising the plug out of blocking engagement with the drain hole to allow beverage within the dispenser body to drain out of the drain hole, said plug being attached to one end of a relatively narrow, elongate, handle mounted entirely within an interior of the dispenser body.

15. A method of assembling a valve assembly with a beverage dispenser having a hollow dispenser body, a top and a bottom with a drain hole, comprising the steps of:

hooking an actuator with an external actuator surface at one end and an internal valve member engagement surface over a slot in the top of the dispenser body;

placing an elongate movable valve handle with a collar into the dispenser body; and pushing the handle against a narrow frontal slot between a pair of fingers carried by the valve member engagement surface until being resiliently spread apart sufficiently to allow passage of the handle into snug engagement within the frontal slot and beneath the collar.

16. A method of dispensing beverage from a beverage dispenser having body with a top with a top edge, a middle and a bottom beneath the top and the middle, comprising the steps of:

releasably, pivotally mounting a valve actuator at a location adjacent to, but spaced beneath the top edge of the beverage dispenser and spaced from the middle;

pressing on the valve actuator at location adjacent to, but beneath, the top edge of the beverage dispenser and spaced from the middle to pivot the valve actuator in a direction toward the dispenser body to open a valve in the bottom of the dispenser;

supporting the valve in the bottom of the dispenser above a serving size beverage container with a supporting means fixedly attached to the beverage dispenser body; and dispensing beverage from the valve at the bottom of the dispenser at a location substantially spaced beneath the valve actuator into the serving size beverage container.

17. The dispensing method of claim 16 including the step of protectively sandwiching the valve actuator with a pair of valve actuator guards.

18. The dispensing method of claim 16 including the step of closing the valve by releasing pressure on the valve actuator to allow gravity to move the actuator to move to a closed position.

19. The dispensing method of claim 16 including the step of using the sides of a tapered plug to guide the plug into a closed position within a drain hole.

* * * * *